US007886928B2

(12) United States Patent
Mengeu

(10) Patent No.: US 7,886,928 B2
(45) Date of Patent: Feb. 15, 2011

(54) CONTAINER WITH VENTING CLOSURE ASSEMBLY

(75) Inventor: Gary L. Mengeu, Wheeling, WV (US)

(73) Assignee: Silgan Plastics Corporation, Chesterfield, MO (US)

( * ) Notice: Subject to any disclaimer, the term of this patent is extended or adjusted under 35 U.S.C. 154(b) by 910 days.

(21) Appl. No.: 11/414,102

(22) Filed: Apr. 28, 2006

(65) Prior Publication Data

US 2007/0251913 A1 Nov. 1, 2007

(51) Int. Cl.
*B65D 51/16* (2006.01)
*B65D 43/08* (2006.01)
*B65D 43/02* (2006.01)
*B65D 45/16* (2006.01)

(52) U.S. Cl. ..... 220/366.1; 220/367.1; 220/361; 220/797; 220/796; 220/324

(58) Field of Classification Search ..... 220/366.1, 220/367.1, 361, 797, 796, 324, 319, 315, 220/795, 780, 582, 581; 215/224
See application file for complete search history.

(56) References Cited

U.S. PATENT DOCUMENTS 1,985,788 A 12/1934 Gore-Lloyd
2,424,801 A 7/1947 Crabbe et al.
3,071,276 A 1/1963 Pellett et al.
3,114,467 A 12/1963 Montgomery
3,173,571 A 3/1965 Cserny et al.
3,239,091 A 3/1966 Driscoll
3,381,872 A 5/1968 Holder et al.
3,401,820 A 9/1968 Taylor
3,589,545 A * 6/1971 Carpenter et al. ..... 215/260
3,613,938 A 10/1971 Westcott
3,717,276 A 2/1973 Luczak et al.
3,720,348 A 3/1973 Jakobsen
3,951,293 A 4/1976 Schulz (Continued)

FOREIGN PATENT DOCUMENTS

CA 1309992 11/1992

*Primary Examiner*—Anthony Stashick
*Assistant Examiner*—Kareen Rush
(74) *Attorney, Agent, or Firm*—Reinhart Boerner Van Deuren s.c.

(57) ABSTRACT

A container for a product which off-gases has a container body with a base wall, sidewall and a large mouth at its upper end bounded by a lip and having an outwardly extending shoulder adjacent the upper end of the sidewall, and a foil seal which extends over the mouth and is adhered to the lip. The foil seal having a valve therein permitting gases in the container body to exit there through. A cap having a top wall and a depending skirt with an internal peripheral snap bead abuts the shoulder on the sidewall of the container body. The top wall of the cap has a depending flexible ring seal bearing on the lip and the inside surface of the cap has channels extending downwardly along the inside surface of the skirt. Gas pressure in the container body will cause the valve in the foil seal to release gas from the interior of the container body into the space in the cap and the pressure of the gas in the ring seal is deflected from the lip to allow the gas to flow thereby and outwardly in the channels in the cap.

20 Claims, 4 Drawing Sheets

U.S. PATENT DOCUMENTS 3,964,670 A 6/1976 Amneus
4,007,848 A * 2/1977 Snyder ..... 215/44
4,121,728 A 10/1978 Tagalakis et al.
4,190,170 A 2/1980 Boyd
4,210,255 A 7/1980 Pan
4,315,578 A 2/1982 Ludwig, Jr.
4,427,126 A 1/1984 Ostrowsky
4,501,371 A 2/1985 Smalley
4,531,649 A * 7/1985 Shull ..... 215/232
4,533,064 A 8/1985 Kawamata et al.
4,545,498 A 10/1985 Schmid
4,653,661 A 3/1987 Buchner et al.
4,738,370 A 4/1988 Urmston et al.
4,747,502 A 5/1988 Luenser
4,789,074 A 12/1988 Han
4,828,129 A 5/1989 Jonkers
4,966,780 A 10/1990 Hargraves et al.
4,993,572 A * 2/1991 Ochs ..... 215/260
4,997,097 A 3/1991 Krautkramer
5,009,324 A 4/1991 Ochs
5,062,538 A 11/1991 Ochs
5,078,290 A 1/1992 Ochs
5,197,620 A 3/1993 Gregory
5,242,073 A * 9/1993 Willis et al. ..... 220/240
5,344,662 A 9/1994 Payne et al.
5,443,853 A 8/1995 Hayes
5,465,864 A 11/1995 McClean
5,544,779 A 8/1996 Yamamoto et al.
5,579,936 A 12/1996 Costa et al.
5,587,192 A * 12/1996 Beizermann ..... 426/118
5,650,113 A 7/1997 Gregory et al.
5,688,544 A 11/1997 Bolton et al.
5,730,306 A 3/1998 Costa et al.
5,785,196 A 7/1998 Montgomery
5,868,273 A 2/1999 Daenen et al.
5,954,214 A 9/1999 Guezennec et al.
5,955,127 A 9/1999 Glaser
5,984,124 A 11/1999 Takano
6,006,930 A * 12/1999 Dreyer et al. ..... 215/44
6,123,212 A * 9/2000 Russell et al. ..... 215/330
6,158,604 A * 12/2000 Larguia et al. ..... 215/217
6,194,011 B1 2/2001 Glaser
6,488,165 B1 * 12/2002 Hidding ..... 215/344
6,578,726 B1 6/2003 Schaefer
6,588,617 B1 7/2003 Majcen et al.
6,662,827 B1 12/2003 Clougherty et al.
6,761,279 B1 * 7/2004 Martin et al. ..... 220/258.2
6,783,015 B1 8/2004 Bosl et al.
6,786,329 B2 * 9/2004 Onishi ..... 206/209
6,983,857 B2 1/2006 Miller et al.
7,074,443 B2 * 7/2006 Thomas et al. ..... 426/118
2003/0006234 A1 * 1/2003 Maslowski ..... 220/319
2003/0116571 A1 * 6/2003 Sulzbach et al. ..... 220/319
2004/0096552 A1 5/2004 Thomas et al.
2004/0173626 A1 9/2004 Jeor
2005/0103742 A1 * 5/2005 Pairis ..... 215/344
2008/0073366 A1 * 3/2008 Backaert ..... 220/785

* cited by examiner

CONTAINER WITH VENTING CLOSURE ASSEMBLY

BACKGROUND OF THE INVENTION

The present invention relates to containers and, more particularly, containers for products which outgas and which employ venting elements.

As is well known, certain products such as coffee tend to outgas and this can cause distortion of the container if the pressure in the container becomes too great, especially in thin walled containers. As a result, some containers use a wall thickness which is increased from that required for a product which does not outgas. This outgassing problem is accentuated with some packaging techniques which utilize the step of purging the ground and roasted coffee to displace oxygen as described in Canadian Patent No. 1,309,992.

Various structures have been proposed to vent the gas evolved from the product such as those shown in Thomas et al Patent Publication US 2004/0096552; Costa et al U.S. Pat. No. 5,370,306; and Jeor U.S. Patent Publication US 2004/0173626.

Although it is desirable to vent the escaping gas, some gas retention is desirable to provide a positive pressure to preclude entry of the ambient air into the container since moisture and gases may be deleterious to the product.

Some containers employ a foil seal to cover the mouth of the container and provide a barrier to ingress of ambient air. This foil seal is removed by the user in order to gain access to the product therein after which there is no longer an effective barrier to protect the contents from moist air, etc. Since there is a need to provide venting for the gas, a valve is provided in the foil seal such as that shown in the Thomas et al Patent Publication.

It is an object of the present invention to provide a novel container assembly for products which offgas during storage and which provide sealing action.

It is also an object to provide such a novel container assembly in which there is a foil seal that shields the product from the atmosphere until the user removes it and a valved vent is provided therein.

Another object is to provide such a container which can be fabricated and assembled easily.

SUMMARY OF THE INVENTION

It has now been found that the foregoing and related objects may be readily attained in a container for a product which off-gases comprising a container body with a base wall, sidewall and a large mouth at its upper end bounded by a lip and having an outwardly extending shoulder adjacent the upper end of the sidewall and below the lip. A foil seal extends over the mouth and is adhered to the lip, and it contains a valve therein permitting gases in the container body to exit there through. Secured to the container body is a cap having a top wall and a depending skirt with an internal peripheral snap bead located and configured to abut the lower surface of the shoulder on the sidewall of the container body. The bottom surface of the top wall of the cap has a depending flexible ring seal bearing on the lip of the container body. The inside surface of the cap has a multiplicity of channels extending downwardly along the inside surface of the skirt. Gas pressure in the container body will cause the valve in the foil seal to release gas from the interior of the container body into the space in the cap above the foil seal. The pressure of the gas in the space builds until it deflects the ring seal from the lip to allow the gas to flow thereby and outwardly in the channels in the cap and discharge to the atmosphere.

Desirably, the channels extend through the snap bead, and the ring seal is inclined outwardly and downwardly and tapers to a reduced thickness at its lower end.

Desirably, the foil seal is a metallic foil, and a valve in the foil seal is provided by a multilayer laminate which permits gases to flow outwardly of the container body but restricts air flow there through into the container body.

DETAILED DESCRIPTION OF THE PREFERRED EMBODIMENTS

Figure 1:
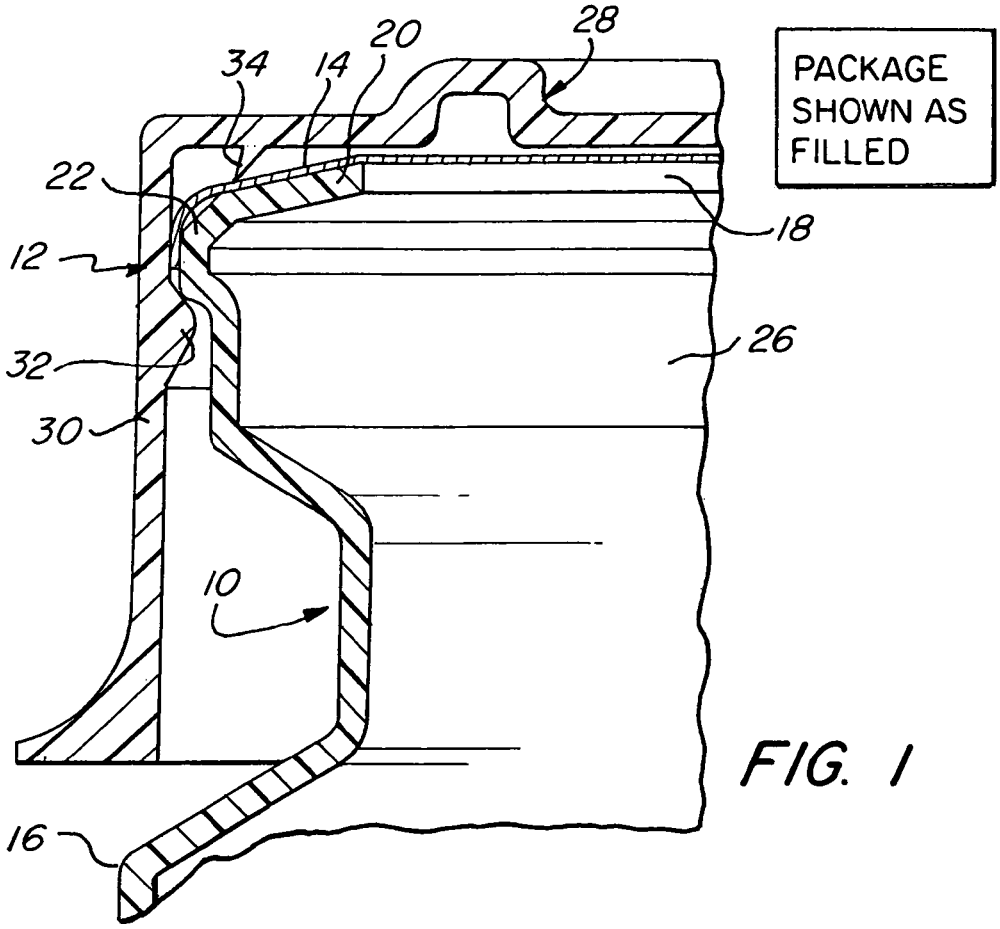
FIG. 1 is a fragmentary sectional view of a container assembly embodying the present invention with the foil seal in place and in the absence of gas at superatmospheric pressure.

Turning first to FIG. 1 of the attached drawings, therein illustrated is a fragmentary container assembly embodying the present invention and comprised of a container generally designated by the numeral 10, a cap generally designated by the numeral 12, and a removable foil seal generally designated by the numeral 14.

The container 10 has a sidewall 16, a bottom wall (not shown) and a mouth 18 at its upper end bounded by an inturned lip portion 20. Adjacent its upper end, the sidewall 16 has an outwardly oriented shoulder 22 which extends about the circumference thereof and a reduced diameter neck portion 24 therebelow. The foil seal 14 extends over the mouth 18 and is adhered to the lip portion 20, thus sealing the interior chamber 26.

The cap 12 has a top wall generally designated by the numeral 28 and a depending skirt generally designated by the numeral 30, and a snap bead 32 is formed on the inner surface. When the cap 12 is pushed onto the container 10, the skirt 30 is resiliently deflected outwardly to permit the snap bead 32 to pass by the shoulder 22 and seat therebelow. The inclined top and bottom surfaces of the snap bead 32 provide a camming action to facilitate engagement and removal of the cap 12.

Depending from top 28 of the cap is a ring seal 34 which extends about the mouth 18 and bears upon the foil seal 14 and underlying lip portion 20 so as to seal the space around the mouth 18 from the atmosphere. The ring seal 34 is downwardly and radially outwardly oriented and tapers to a reduced cross section at its lower end to permit its deflection radially outwardly. This sealing action will occur with the foil seal 14 still in place and after its removal by the user. A multiplicity of vent channels 36 extend downwardly through the snap bead 32.

Centrally of the mouth 18, the foil seal 14 has a one-way valve 38 which is constructed to allow gas to exit the chamber 26. Generally, such valves are comprised of multiple parts with passages which are opened when the seal is distorted by pressure on one side. Seals with venting valves of various constructions are shown in the following patents: Thomas et al Patent Publication US 2004/0096552; Costa et al U.S. Pat. No. 5,370,306; and Jeor U.S. Patent Publication US 2004/0173626; Pan U.S. Pat. No. 4,210,255; Buchner et al U.S. Pat. No. 4,653,661; Jonkers U.S. Pat. No. 4,828,129; Clougherty et al U.S. Pat. No. 6,662,827 and Miller et al U.S. Pat. No. 6,983,857.

Figure 2:
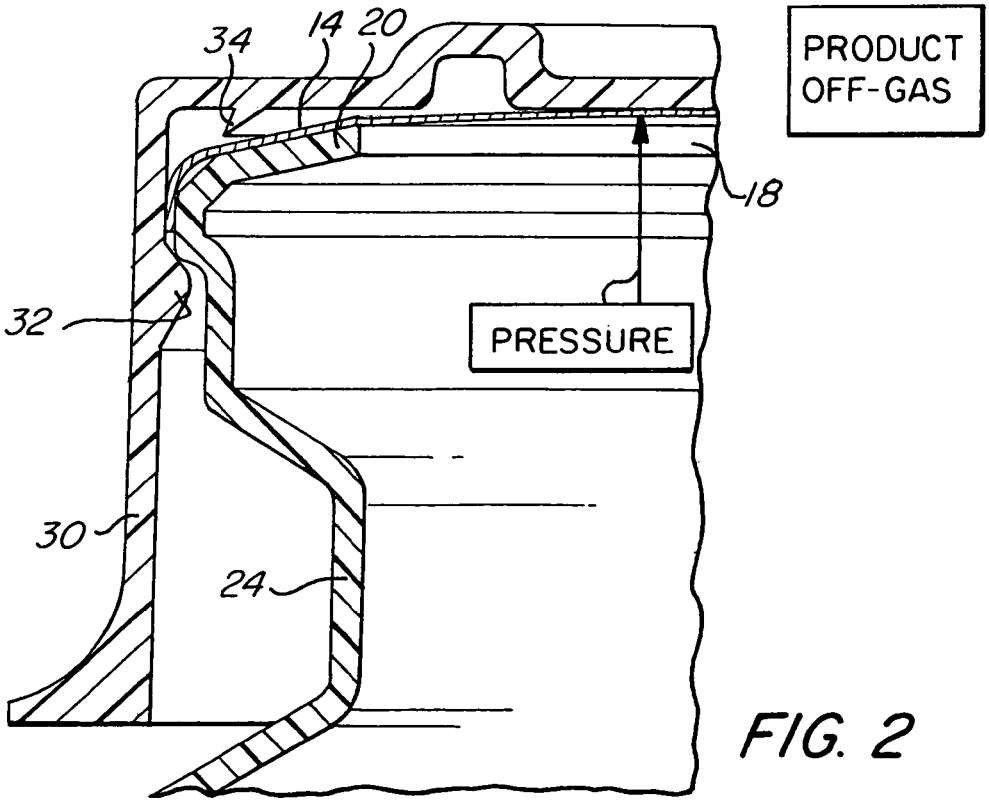
FIG. 2 is a similar view showing the foil seal and the top wall of the cap bowed upwardly by gas released from the contents of the container.
Figure 3:
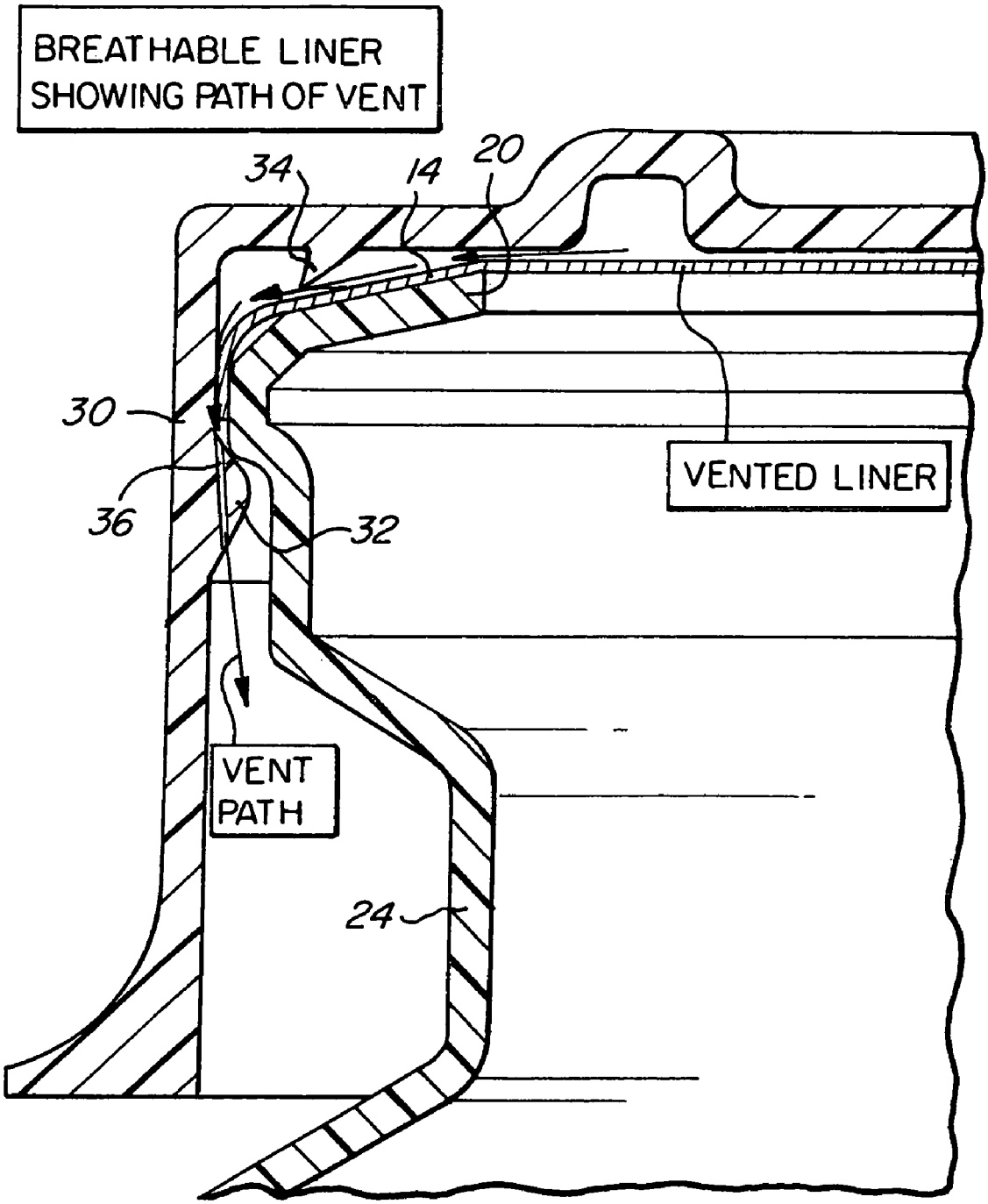
FIG. 3 is a similar view showing the discharge path for gas passing through the valve in the foil seal.
Figure 4:
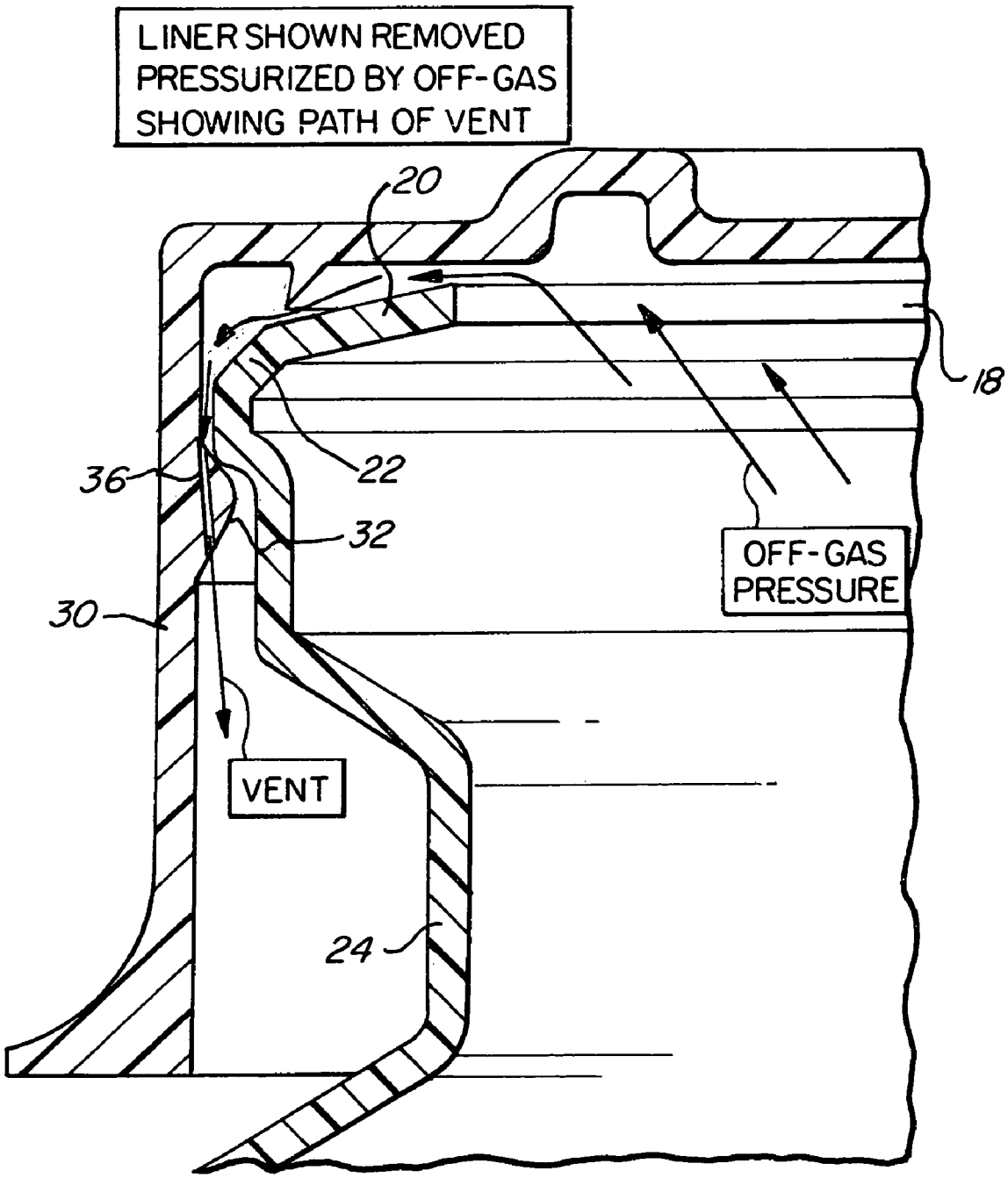
FIG. 4 is a view similar to FIG. 3 but with the foil seal removed.
Figure 5:
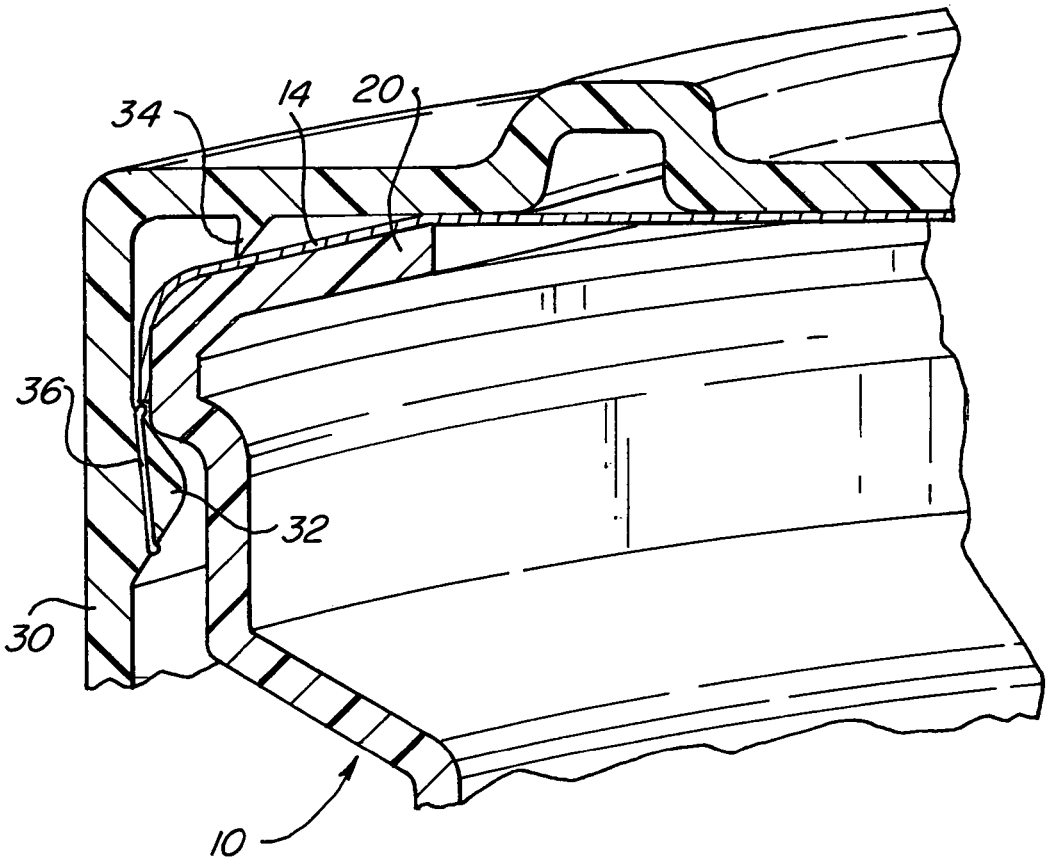
FIG. 5 is a view similar to FIG. 1 showing a vent channel in the snap bead of the cap.
Figure 6:
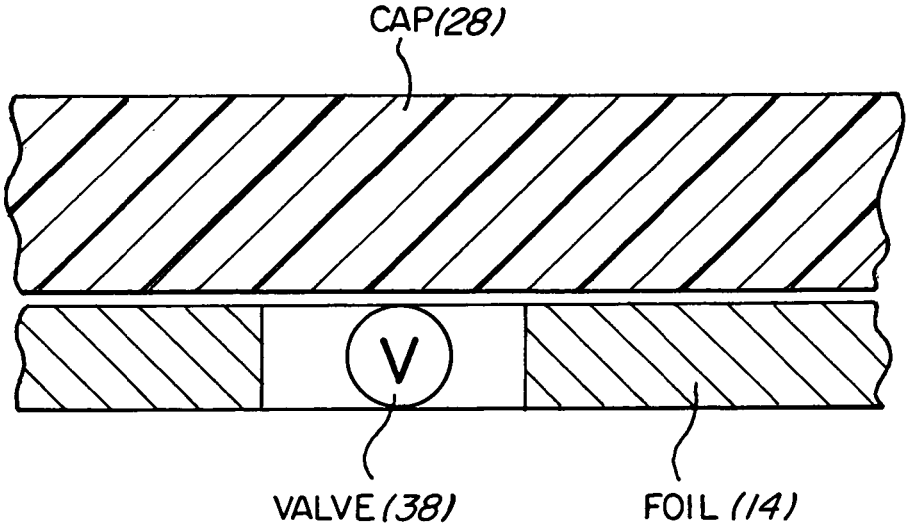
FIG. 6 is a fragmentary sectional view drawn to an enlarged scale and seal showing the cap and the valve in the foil seal.

In operation, the product is placed in the chamber 26 of the container 10 and the foil seal 14 is adhered to the lip 20 so as to provide a closed chamber 26. As the amount (and pressure) of the gas released from the product builds up in the chamber 26, the gas acts upon the foil seal to cause it to assume a dome-like orientation seen in FIG. 2. Depending on the valve orientation employed, this may cause distension of the valve 38 to the point where the valve permits gas to pass there through and into the small chamber in the cap 12 bounded by the ring seal 34. When the pressure of the gas in the small chamber increases sufficiently, the gases cause the ring seal 34 to deflect and lift from the foil seal 14 so that the gas may escape thereunder and flow in the space between the container 10 and cap 12 until it reaches the snap bead 32 and then through the vent channels 36 in the snap bead 32 to the atmosphere.

When the user initially opens the container assembly, the foil seal 14 is removed and the ring seal 34 now bears directly on the lip portion 20 to prevent gas from escaping from the container 10 until the pressure reaches a level sufficient to cause deflection of the ring seal 34.

When the ring seal 34 is deflected, there is a short burst of gas released through the snap bead vent channels 36. The ring seal 34 then returns to its sealing position until the gas pressure in the small chamber again reaches a level sufficient to cause deflection and release—a process which is referred to as "burping".

The configuration of the cap and container can be readily varied from those in the attached drawings so long as the container has a lip about the mouth of the container upon which the ring seal may bear to effect a seal after the foil seal has been removed for access to the contents. It will be appreciated that the ring seal will effectively limit entry of humid or ambient air into the container, and this barrier effect is also provided by superatmospheric pressure of gas from the stored contents in the small chamber.

Having thus described the invention, what is claimed is:

1. A container for a product which off-gases comprising:

(a) a container body with a sidewall and a mouth at its upper end bounded by a lip and having an outwardly extending shoulder adjacent the upper end of the sidewall and below the lip;

(b) a seal extending over said mouth and adhered to said lip, said seal having a valve therein permitting gases in said container body to exit there through; and (c) a cap having a top wall and a depending skirt defined by at least an inner wall and an outer wall with an internal peripheral snap bead located and configured to abut the lower surface of the shoulder on the sidewall of the container body, the bottom surface of said top wall of said cap having a depending flexible ring seal bearing on said lip, said cap having at least one channel in the inner wall extending downwardly through the skirt without extending through said outer wall;

whereby gas pressure in the container body will cause said valve in said seal to release gas from the interior of the container body into the space in the cap above said seal and the pressure of the gas in the space lifts said ring seal from said lip to allow the gas to flow thereby and outwardly in the at least one channel in the cap and discharge to the atmosphere.

2. The container of claim 1 wherein said at least one channel extends through said snap bead.

3. The container of claim 1 wherein said ring seal is inclined outwardly and downwardly.

4. The container of claim 3 wherein said ring seal tapers to a reduced thickness at its lower end.

5. The container of claim 1 wherein said seal is a metallic foil.

6. The container of claim 1 wherein said valve in said seal is provided by a laminate which permits gases to flow outwardly of said container body but restricts air flow there through into said container body.

7. The container of claim 1 wherein the seal is removable, and further wherein the ring seal bears directly on the lip after the seal is removed.

8. A container comprising:

a sidewall defining an interior chamber;

a lip extending from the sidewall, the lip having an upper surface and an inner edge, wherein the inner edge of the lip defines a mouth of the container;

a cap engaged with the sidewall, the cap having a skirt having an inner wall and an outer wall and a seal depending from the bottom surface of the cap, the seal bearing on the upper surface of the lip when the cap is exposed to a first internal pressure and, while the cap remains engaged with the sidewall, the seal lifting from at least a portion of the upper surface of the lip when the cap is exposed to a second internal pressure;

the skirt including at least one channel in the inner wall extending downwardly through a portion of the skirt without extending through the outer wall;

wherein the seal substantially prevents gas from passing between the seal and the upper surface of the lip at the first internal pressure and allows gas to pass between the seal and the upper surface of the lip at the second internal pressure.

9. The container of claim 8, wherein the seal is a ring seal.

10. The container of claim 9, wherein the ring seal is inclined outwardly and downwardly, and said ring seal tapers to a reduced thickness at its lower end.

11. The container of claim 8 further comprising a removable foil seal adhered to the lip, the foil seal including a valve therein permitting gases in the interior chamber to pass through the valve.

12. The container of claim 8, wherein the sidewall includes an outwardly extending shoulder, the outwardly extending shoulder positioned below the lip.

13. The container of claim 12, wherein the cap includes an internal peripheral snap bead located and configured to abut the lower surface of the outwardly extending shoulder, and further wherein the at least one channel extends through the snap bead such that gas is allowed to pass through the at least one channel into the atmosphere.

14. The container of claim 13 wherein an upper end of the at least one channel is above the point of abutment between the peripheral snap bead and the outwardly extending shoulder and a lower end of the at least one channel is below the point of abutment between the peripheral snap bead and the outwardly extending shoulder.

15. The container of claim 8 wherein the seal is configured to lift from the at least a portion of the upper surface of the lip when the cap is exposed to a second pressure resulting from the release of gas by the contents of the container.

16. The container of claim 13 wherein the snap bead of the cap includes a first surface facing an upper end of the sidewall and a second surface facing the lower end of the sidewall, wherein the at least one channel is a through-bore formed through the snap bead such that the channel includes a first opening positioned in the first surface of the snap bead and a second opening positioned in the second surface of the snap bead.

17. A cap engageable with a container body, the container body having an interior and a lip defining a container mouth, the cap comprising:

a top wall having an outer surface, an inner surface, and an outer edge;

a skirt extending from the top wall having an inner surface and an outer surface and including a formation configured to engage the container body to hold the cap to the container body;

the formation including at least one channel defined therein, the channel extending downwardly through the formation without extending through the outer surface of the skirt; and a seal extending from the inner surface of the top wall and positioned on the inner surface to be adjacent to the lip when the formation is engaged with the container body, wherein, while the formation is engaged with the container body, at least a portion of the seal can lift from the lip when the pressure in the interior is greater than the pressure external to the container body and cap.

18. The cap of claim 17 wherein the seal is a ring seal.

19. The cap of claim 18 wherein the ring seal extends from a portion of the inner surface of the top wall substantially adjacent to the skirt.

20. The cap of claim 17 wherein the formation is an internal peripheral snap bead extending from the inner surface of the skirt.

* * * * *